US009533206B2

(12) United States Patent
Dobson, III

(10) Patent No.: US 9,533,206 B2
(45) Date of Patent: Jan. 3, 2017

(54) TURF MAINTENANCE DEVICE

(75) Inventor: Eben W. Dobson, III, Solana Beach, CA (US)

(73) Assignee: WISP Industries, Inc., San Marcos, CA (US)

( * ) Notice: Subject to any disclaimer, the term of this patent is extended or adjusted under 35 U.S.C. 154(b) by 334 days.

(21) Appl. No.: 13/080,506

(22) Filed: Apr. 5, 2011

(65) Prior Publication Data

US 2012/0149499 A1 Jun. 14, 2012

Related U.S. Application Data

(60) Provisional application No. 61/422,589, filed on Dec. 13, 2010.

(51) Int. Cl.
*A46B 9/02* (2006.01)
*A46B 17/02* (2006.01)

(52) U.S. Cl.
CPC ..... *A63B 57/50* (2015.10); *A46B 9/02* (2013.01); *A46B 17/02* (2013.01); *A46B 2200/302* (2013.01)

(58) Field of Classification Search
CPC ... A46B 2200/302; A46B 9/02; A46B 5/0095; A46B 3/00; A46B 7/04; A46B 17/02; A01B 1/00; B08B 1/00
USPC ..... 15/159.1, 160, 176.1, 144.3, 144.4, 146; 56/400.17
See application file for complete search history.

(56) References Cited

U.S. PATENT DOCUMENTS 2,044,595 A * 6/1936 Schumann ..... 15/171
2,264,736 A * 12/1941 Baker ..... 15/147.2
2,694,880 A 11/1954 Artese et al.
2,730,739 A 1/1956 Artese et al.
2,799,037 A 7/1957 Grogan
2,896,241 A * 7/1959 Cotman ..... 15/184
3,349,422 A 10/1967 Heil
3,999,243 A 12/1976 LaPour
D262,671 S * 1/1982 Erickson ..... D4/136
4,794,663 A * 1/1989 Vosbikian ..... A47L 13/24 15/144.1
4,882,802 A * 11/1989 LeVere, Jr. ..... 15/144.1
5,001,802 A * 3/1991 Humphrey ..... 15/159.1
5,943,727 A * 8/1999 Freer ..... A46B 5/0033 15/144.1

(Continued)

FOREIGN PATENT DOCUMENTS

GB 2150016 A * 6/1985

*Primary Examiner* — Laura C Guidotti
(74) *Attorney, Agent, or Firm* — San Diego IP Law Group LLP; Trevor Goddington

(57) ABSTRACT

A turf maintenance device (12) for maintaining a section of turf (10) comprises a plurality of bristles (26) that form a bristle array (546) having an array length (AL) and an array width (AW). In certain alternative embodiments, the ratio of the array length (AL) to the array width (AW) can be at least approximately ten to one, or at least approximately thirty to one. Further, the plurality of bristles (26) have a bristle length (BL). In certain alternative embodiments, the ratio of the bristle length (BL) to the array width (AW) can be at least approximately three to one, or at least approximately five to one. The turf maintenance device (12) can further comprise a handle (222) that is coupled to the plurality of bristles (26). The handle (222) can include a plurality of handle members (228) that move relative to one another between an extended configuration and a contracted configuration.

14 Claims, 6 Drawing Sheets

(56) References Cited

U.S. PATENT DOCUMENTS

| | | | | |
|---|---|---|---|---|
| 6,088,868 | A * | 7/2000 | Cerveny | 15/144.3 |
| D435,734 | S | 1/2001 | Wolfenden | |
| 6,393,646 | B1 | 5/2002 | Beers, Jr. et al. | |
| 6,625,837 | B2 * | 9/2003 | Jiang | 15/105 |
| 7,587,780 | B2 | 9/2009 | Pfister | |
| 7,600,287 | B1 * | 10/2009 | Moore et al. | 15/144.4 |
| D621,622 | S | 8/2010 | Giacolo et al. | |

* cited by examiner

TURF MAINTENANCE DEVICE

RELATED APPLICATION

This application claims domestic priority under 35 U.S.C. §119(e) from U.S. Provisional Patent Application Ser. No. 61/422,589 filed on Dec. 13, 2010, entitled "Turf Maintenance Device", the entire contents of which are expressly incorporated herein by reference to the extent permitted.

BACKGROUND

Golf course greens and practice greens require considerable maintenance in order to keep the turf, both natural and artificial, in optimal condition so that a putted ball can be expected to roll on a true course. For example, the removal or strategic movement and placement of foreign materials or impediments such as sand and other debris is a necessary part of proper green maintenance. Additionally, the movement of such impediments should be performed carefully to decrease disturbance or damage to or roughing up of the somewhat fragile grass of the green. Moreover, it can be important for the health of the turf as well as for the trueness and/or consistency of the greens to position the individual blades of grass so that they are in a substantially upright orientation with a small separation between the individual blades of grass.

SUMMARY

The present invention is directed to a turf maintenance device for maintaining a section of turf. In various embodiments, the turf maintenance device comprises a plurality of bristles that form a bristle array having an array length and an array width. In one such embodiment, the ratio of the array length to the array width is at least approximately ten to one.

Additionally, in one embodiment, the ratio of array length to array width is at least approximately thirty to one.

Further, in some embodiments, the plurality of bristles have a bristle length. In one such embodiment, the ratio of the bristle length to the array width is at least approximately three to one. Additionally, in one such embodiment, the ratio of bristle length to array width is at least approximately five to one.

Additionally, in certain embodiments, the turf maintenance device further comprises a handle that is coupled to the plurality of bristles. In some embodiments, the handle includes a plurality of handle members that move relative to one another between an extended configuration and a contracted configuration. In one embodiment, the handle members are movable relative to one another in telescoping manner between the extended configuration and the contracted configuration. In another embodiment, the handle members pivot relative to one another between the extended configuration and the contracted configuration.

Moreover, in one embodiment, the turf maintenance device further comprises a channel that retains the plurality of bristles and maintains the positioning of the bristles relative to one another. Additionally, in one embodiment, the turf maintenance device further comprises a housing that removably receives the channel, and a handle that is coupled to the housing. Further, in such embodiment, the handle can be pivotably coupled to the housing.

Additionally, in one embodiment, the handle includes a handle body that defines a handle cavity. In such embodiment, the turf maintenance device can be selectively movable between an operative configuration and a stored configuration. Moreover, in such embodiment, the plurality of bristles are positioned substantially within the handle cavity when the turf maintenance device is in the stored configuration.

Still further, the present invention is also directed to a method for treating a section of turf having a plurality of turf members and one or more impediments positioned on the turf members.

BRIEF DESCRIPTION OF THE DRAWINGS

The novel features of this invention, as well as the invention itself, both as to its structure and, its operation, will be best understood from the accompanying drawings, taken in conjunction with the accompanying description, in which similar reference characters refer to similar parts, and in which.

DESCRIPTION

Figure 1A:
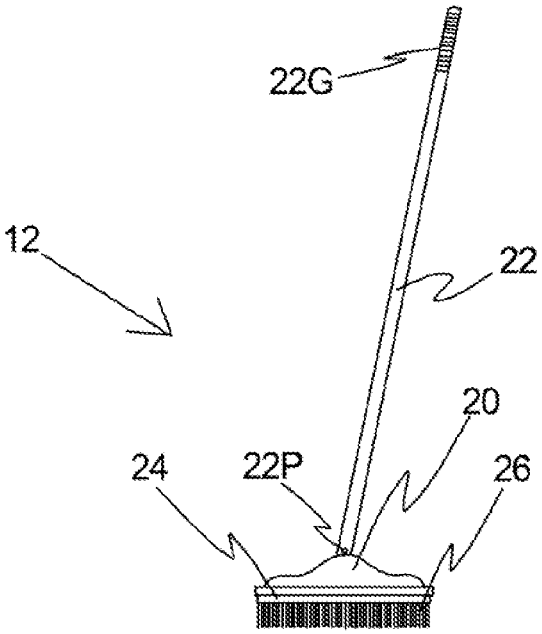
FIG. 1A is a perspective view of an embodiment of a turf maintenance device having features of the present invention.

FIG. 1A is a perspective view of an embodiment of a turf maintenance device 12 having features of the present invention. The design of the turf maintenance device 12 can be varied. In the embodiment illustrated in FIG. 1A, the turf maintenance device 12 includes a housing 20, a handle 22, a channel 24 and a plurality of bristles 26. Alternatively, the turf maintenance device 12 can omit one or more of the housing 20, the handle 22 and the channel 24.

Figure 1B:
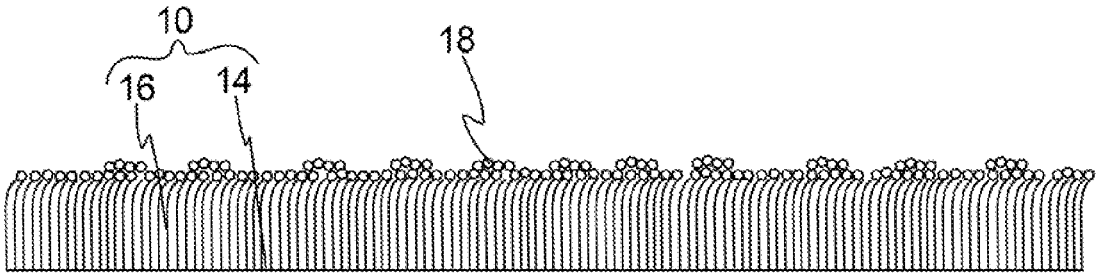
FIG. 1B is a side view of a section of turf that can be treated with the turf maintenance device illustrated in FIG. 1A, the section of turf shown in a pre-treated condition.

FIG. 1B is a side view of a section of turf 10, e.g., a portion of a golf course putting green, which can be treated with the turf maintenance device 12 illustrated in FIG. 1A. More particularly, in FIG. 1B, the section of turf 10 is illustrated in a pre-treated condition, e.g., prior to the turf maintenance device 12 being used to perform certain maintenance functions on and/or related to the section of turf 10. As illustrated, the section of turf 10 includes a turf base 14 and a plurality of turf members 16, e.g., blades of grass, that are positioned partially within the turf base 14 and that extend in a generally upward direction away from the turf base 14. Additionally, as shown, the turf members 16 are positioned substantially adjacent to one another. Further, as shown in FIG. 1B, a plurality of impediments 18, e.g., grains of sand from a sand trap and/or other relatively small impediments, are positioned substantially on top of the turf members 16. Importantly, the turf illustrated in FIG. 1B can be either natural grass or artificial turf, and it is recognized that the present invention can be utilized with either.

Figure 1C:
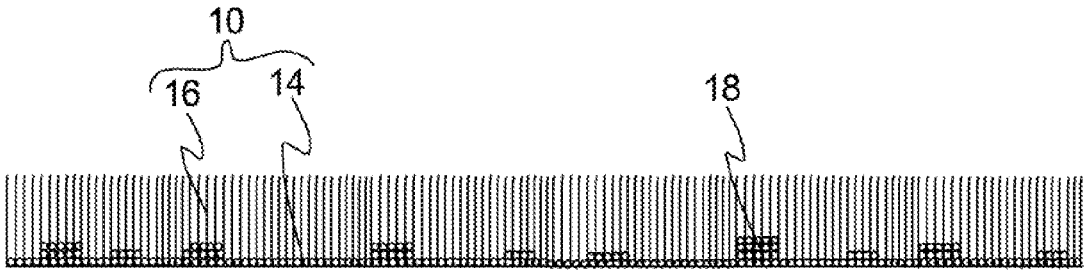
FIG. 1C is another side view of the section of turf illustrated in FIG. 1B, the section of turf shown in a treated condition.

FIG. 1C is another side view of the section of turf 10 illustrated in FIG. 1B. In particular, in FIG. 1C, the section of turf 10 is illustrated in a treated condition, with the plurality of impediments 18 having been moved by the turf maintenance device 12 (illustrated in FIG. 1A) so that the impediments 18 are positioned between the turf members 16 and substantially adjacent to the turf base 14. With the impediments 18 having been moved to between the turf members 16, the turf members 16 are better able to stand up straighter so as to provide a stronger, healthier and truer surface on which a golf ball can roll.

As an overview, the turf maintenance device 12 is useful for moving the plurality of impediments 18 from the top of the turf members 16 (as illustrated in FIG. 1B) to between the turf members 16 (as illustrated in FIG. 1C), e.g., between the individual blades of grass, and substantially adjacent to the turf base 14. Moreover, the turf maintenance device 12 provides a treatment of the turf members 16 such that the turf members 16 are able to stand up straighter and/or truer, and thus are stronger, healthier, more consistent and/or maintained in a better condition for use. More particularly, the turf maintenance device 12 gently moves across the surface of the turf members 16 to move the plurality of impediments 18 to between the turf members 16 while inhibiting any potential damage to the individual turf members 16, as opposed to previous devices which were merely designed to rake or sweep debris out of the way, which can and does cause damage to the individual turf members.

Referring back to FIG. 1A, as will be described in greater detail below, the housing 20 is connected to and is positioned substantially between the handle 22 and the channel 24. In one embodiment, the housing 20 removably receives and retains a portion of one or more of the handle 22 and/or the channel 24. Alternatively, the handle 22 can removably receive and retain a portion of the housing 20 and the channel 24 can removably receive and retain a portion of the housing 20. For example, in one embodiment, the handle 22 can be secured to the housing 20 with a fastener (not shown) such as a screw, bolt or other suitable type of fastener. In an alternative embodiment, the handle 22 can be frictionally held in place, e.g. under compression, by the housing 20. Still alternatively, the housing 20 can be formed as an integrated unit with the channel 24 and/or with the handle 22. In another embodiment, the turf maintenance device 12 can omit the housing 20, and the handle 22 can be directly secured to the channel 24.

As noted above, in this embodiment, the handle 22 is connected to the housing 20. As shown in FIG. 1A, the handle 22 can be a pole-type handle that has a unitary structure and extends in a substantially straight line away from the housing 20. Additionally, in certain embodiments, the handle 22 can include a grip region 22G that can be easily gripped by the user to enable the user to easily manipulate the other members of the turf maintenance device 12. Alternatively, the handle 22 can have a different design and/or the handle 22 can extend away from the housing other than in a substantially straight line. For example, in certain non-exclusive alternative embodiments, the handle 22 can be a foldable handle, a telescoping-type handle, or some other type of handle.

Additionally, as illustrated in FIG. 1A, the handle 22 can include a handle pivot 22P so that the handle 22 can be pivotably coupled to the housing 20. With this design, the handle 22 and/or the turf maintenance device 12 can fold up more compactly and conveniently for purposes of storage and transport. Still alternatively, in certain embodiments, the turf maintenance device 12 can omit the handle, and the user can directly hold and manipulate the housing 20, the channel 24 and/or the plurality of bristles 26.

Further, as noted above, the channel 24 is connected to the housing 20. Additionally, the channel 24 retains the plurality of bristles 26, such that the bristles 26 cantilever substantially perpendicularly away from the channel 24. Still further, the channel 24 maintains the positioning of the bristles 26 relative to one another. Moreover, as shown, the bristles cantilever substantially perpendicularly away from the housing 20. Alternatively, the turf maintenance device 12 can omit the channel 24 and the bristles 26 can be directly coupled to the housing 20.

The bristles 26 are sized and shaped and oriented relative to one another to enable the turf maintenance device 12 to effectively move the impediments 18 from an upper (top) surface of the turf members 16 to between the turf members 16 and adjacent to the turf base 14 while inhibiting any potential damage to the individual turf members 16. More particularly, in this embodiment, the user can easily grip the handle 22, i.e. the grip region 22G, so that the user can quickly, easily and gently manipulate the bristles 26 across the surface of the turf members 16 in order to move the plurality of impediments 18 from the top of the turf members 16 to between the turf members 16 and adjacent to the turf base 14.

Figure 2A:
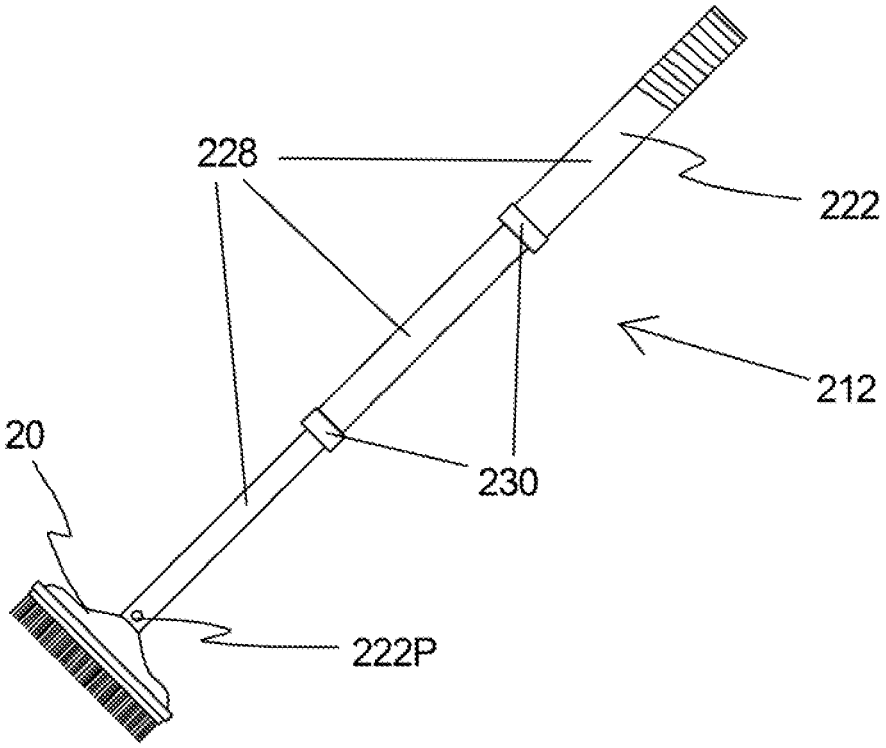
FIG. 2A is a perspective view of another embodiment of the turf maintenance device, shown in an extended configuration.
Figure 2B:
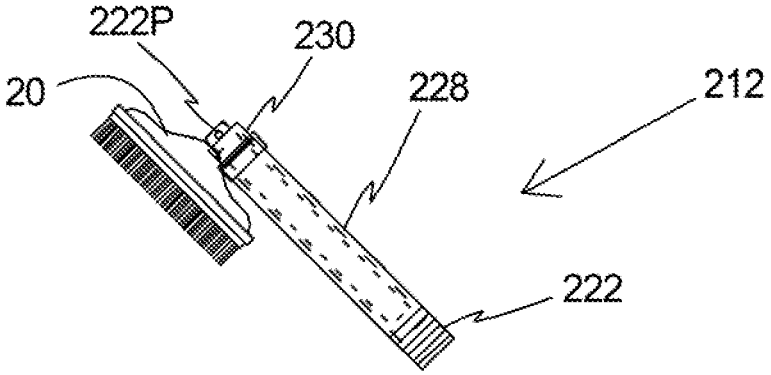
FIG. 2B is a perspective view of the turf maintenance device illustrated in FIG. 2A, shown in a contracted configuration.

FIGS. 2A-2B are perspective views of alternative embodiment of a turf maintenance device 212 having features of the present invention. The turf maintenance device 212 is somewhat similar to the turf maintenance device 12 illustrated in FIG. 1A. However, in this embodiment, the turf maintenance device 212 includes a handle 222 that has a design that is somewhat different than in the previous embodiment. As illustrated, the handle 222 includes a plurality of handle members 228 and one or more member connectors 230.

In this embodiment, the handle members 228 are movable relative to one another between an extended configuration, as illustrated in FIG. 2A, and a contracted configuration, as illustrated in FIG. 2B. In particular, in this embodiment, the sizes of the individual handle members 228 are slightly different from one another. Further, the handle members 228 can be substantially hollow so that the handle members 228 can move and/or slide relative to one another in telescoping manner between the extended configuration and the contracted configuration, with the smaller handle members 228 fitting inside the larger handle members 228. As shown in FIG. 2A, when in the extended configuration, the handle members 228 form a full-length handle 222 such that a person can easily use the turf maintenance device 212 while standing upright, without the need to bend over or otherwise move their body into what may be an uncomfortable position. Conversely, when in the contracted configuration, as shown in FIG. 2B, the handle members 228 are positioned one inside another (the smaller handle members 228 positioned inside the largest handle member 228 are illustrated in phantom) so that the handle members 228 and/or the turf maintenance device 212 has a much more compact overall form so as to greatly enhance the convenience of storage and/or transport of the turf maintenance device 212. Further, in some embodiments, the handle 222 can include a handle pivot 222P to enable the handle 222 to pivot relative to the housing 20 so that the turf maintenance device 212 can have an even more compact overall form.

As illustrated in this embodiment, the handle 222 includes three handle members 228. Alternatively, the handle 222 can include greater than three or less than three handle members 228 that move relative to one another in telescoping manner between the extended configuration and the contracted configuration. Still alternatively, the handle members 228 can move relative to one another in a different manner.

The connector members 230 connect the handle members 228 to one another. In certain embodiments, the member connectors 230 are movable between a locked position and an unlocked position. In the locked position, the member connectors 230 inhibit the handle members 228 from moving relative to one another. Conversely, in the unlocked position, the member connectors 230 allow the handle members 228 to move relative to one another in telescoping manner between the extended configuration and the contracted configuration. The design of the member connectors 230 can vary. For example, in one non-exclusive alternative embodiment, the member connectors 230 can be rotated in order to move between the locked position and the unlocked position.

In the embodiment illustrated in FIG. 2A, the handle 222 includes two member connectors 230, with one member connector 230 being positioned substantially between each pair of adjacent handle members 228 when the handle members 228 are in the extended configuration. Alternatively, the handle 222 can include greater than two or less than two member connectors 230. Further, as shown in FIG. 2B, the member connectors 230 are positioned substantially adjacent to one another when the handle 222 is positioned in the contracted configuration.

Figure 3A:
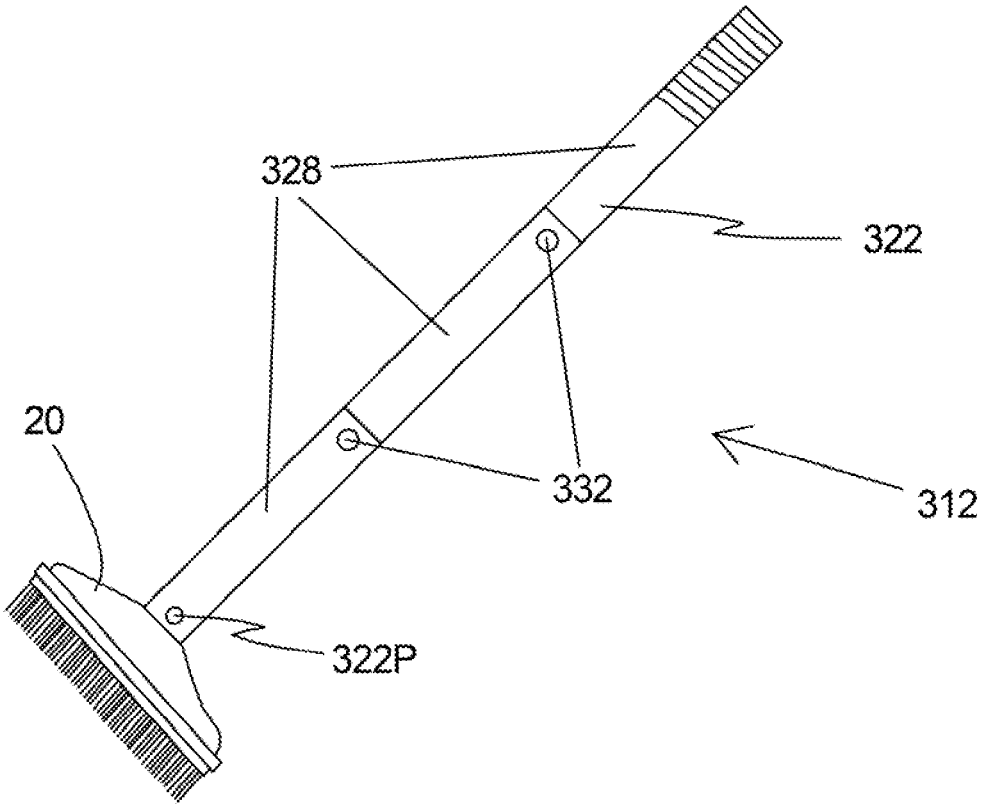
FIG. 3A is a perspective view of still another embodiment of the turf maintenance device, shown in an extended configuration.
Figure 3B:
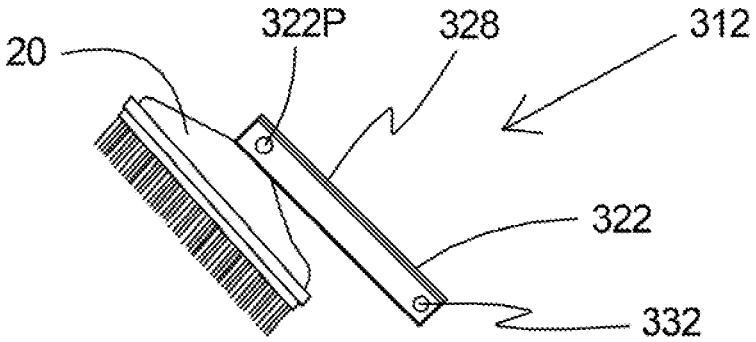
FIG. 3B is another perspective view of the turf maintenance device illustrated in FIG. 3A, shown in a contracted configuration.

FIGS. 3A-3B are perspective views of another alternative embodiment of a turf maintenance device 312 having features of the present invention. The turf maintenance device 312 is somewhat similar to the turf maintenance devices 12, 212 illustrated in FIGS. 1A, 2A, respectively. However, in this embodiment, the turf maintenance device 312 includes a handle 322 that has a design that is somewhat different than in the previous embodiments. As illustrated, the handle 322 includes a plurality of handle members 328 and one or more pivot pins 332.

In this embodiment, the handle members 328 are movable relative to one another between an extended configuration, as illustrated in FIG. 3A, and a contracted configuration, as illustrated in FIG. 3B. In particular, in this embodiment, the handle members 328 can pivot relative to one another so that the handle members 328 can be effectively folded into the contracted configuration and/or unfolded into the extended configuration. Similar to the previous embodiment, when in the extended configuration, as shown in FIG. 3A, the handle members 328 form a full-length handle 322 such that a person can easily use the turf maintenance device 312 while standing upright, without the need to bend over or otherwise move their body into what may be an uncomfortable position. Conversely, when in the contracted configuration, as shown in FIG. 3B, the handle members 328 have been pivoted relative to one another so that the handle members 328 are positioned substantially adjacent to one another, i.e. side-by-side. Thus, in the contracted configuration, the handle members 328 and/or the turf maintenance device 312 have a much more compact overall form so as to greatly enhance the convenience of storage and/or transport of the turf maintenance device 312. Further, as with the previous embodiments, the handle 322 can include a handle pivot 322P to enable the handle 322 to pivot relative to the housing 20 so that the turf maintenance device 312 can have an even more compact overall form.

As illustrated in this embodiment, the handle 322 includes three handle members 328. Alternatively, the handle 322 can include greater than three or less than three handle members 328 that can pivot relative to one another between the extended configuration and the contracted configuration. Still alternatively, the handle members 328 can move relative to one another in a different manner.

The pivot pins 332 connect the handle members 328 to one another. In certain embodiments, the pivot pins 332 are movable between a locked position and an unlocked position. In the locked position, the pivot pins 332 inhibit the handle members 328 from moving relative to one another. Conversely, in the unlocked position, the pivot pins 332 allow the handle members 328 to pivot relative to one another between the extended configuration and the contracted configuration. The design of the pivot pins 332 can vary.

As illustrated in FIG. 3A, the handle 322 includes two pivot pins 332, with one pivot pin 332 being positioned so as to pivotably connect each pair of adjacent handle members 328. Alternatively, the handle 322 can include greater than two or less than two pivot pins 332.

Figures 4A, 4B, 4C, 4D, 4E:
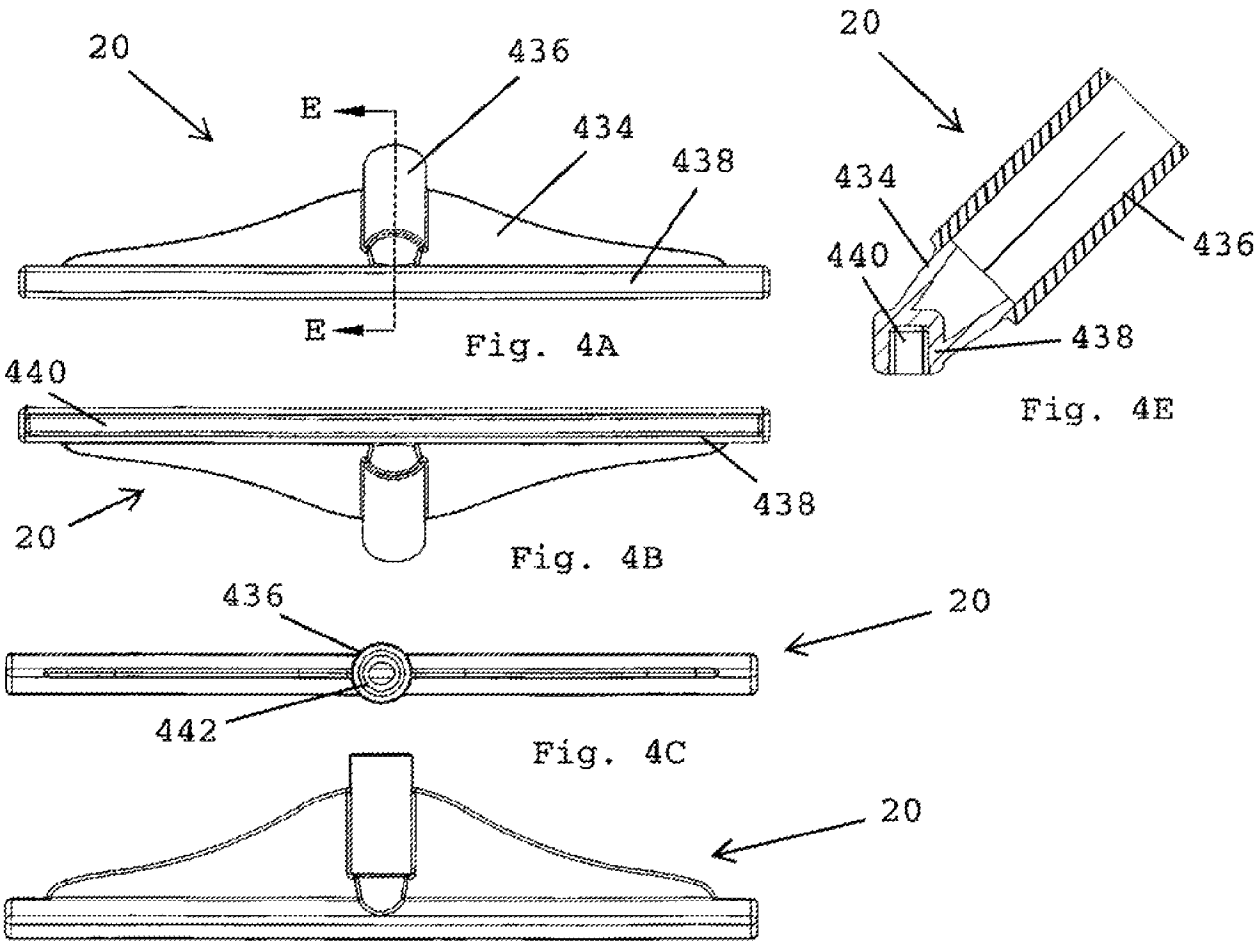
FIG. 4A is a front view of a portion of the turf maintenance device illustrated in FIG. 1A, including one embodiment of a housing.
FIG. 4B is a bottom view of the housing illustrated in FIG. 4A.
FIG. 4C is a top view of the housing illustrated in FIG. 4A.
FIG. 4D is a rear view of the housing illustrated in FIG. 4A.
FIG. 4E is a cross-sectional view of the housing taken on line E-E in FIG. 4A.

FIG. 4A is a front view of an embodiment of the housing 20 that forms a portion of the turf maintenance device 12 illustrated in FIG. 1A. The design of the housing 20 can be varied to suit the specific requirements of the turf maintenance device 12. As illustrated in this embodiment, the housing 20 can include a housing body 434, a handle retainer 436, and a channel retainer 438.

The housing body 434 is connected to and/or is integrally formed with the handle retainer 436 and the channel retainer 438. Further, the housing body 434 provides structural integrity between the handle retainer 436 and the channel retainer 438. As shown, the housing body 434 includes a pair of substantially triangular portions that extend between the handle retainer 436 and the channel retainer 438. Alternatively, the housing body 434 can have a different design.

The handle retainer 436 receives and retains a portion of the handle 22 (illustrated in FIG. 1A). In one embodiment, the handle retainer 436 has a substantially circular cross-section that is adapted to receive and retain a portion of the handle 22 that has a substantially circular cross-section. Alternatively, the handle retainer 436 and/or the portion of the handle 22 retained by the handle retainer 436 can have a different shape.

The channel retainer 438 receives and retains a portion of the channel 24 (illustrated in FIG. 1A). In one embodiment, the channel retainer 438 has a substantially rectangular cross-section that is adapted to receive and retain a portion of the channel 24 that has a substantially rectangular perimeter. More particularly, in the embodiment shown in FIG. 4A, the channel retainer 438 has a substantially rectangular cross-section that is adapted to receive and retain substantially the entire channel 24. Alternatively, the channel retainer 438 and/or the portion of the channel 24 retained by the channel retainer 438 can have a different shape.

FIG. 4B is a bottom view of the housing 20 illustrated in FIG. 4A. In particular, FIG. 4B illustrates the channel retainer 438 more clearly. For example, as illustrated in this embodiment, the channel retainer 438 includes a substantially rectangle shaped channel retainer aperture 440 that is sized and shaped to receive a portion of the channel 24 (illustrated in FIG. 1A). More specifically, in this embodiment, the channel retainer aperture 440 can be of sufficient size such that substantially the entire channel 24 is received and retained within the channel retainer aperture 440. Alternatively, the channel retainer 438 can have a different design.

FIG. 4C is a top view of the housing 20 illustrated in FIG. 4A. In particular, FIG. 4C illustrates the handle retainer 436 more clearly. For example, as illustrated in this embodiment, the handle retainer 436 includes a substantially circular shaped handle retainer aperture 442 that is sized and shaped to receive a portion of the handle 22 (illustrated in FIG. 1A). Alternatively, the handle retainer 436 can have a different design.

FIG. 4D is a rear view of the housing 20 illustrated in FIG. 4A.

FIG. 4E is a cutaway view of the housing 20 taken on line E-E in FIG. 4A. In particular, FIG. 4E more clearly illustrates the channel retainer aperture 440 of the channel retainer 438. Further, in the embodiment illustrated in FIG. 4E, the housing body 434 and the handle retainer 436 extend upwardly at an angle from the channel retainer 438. In one embodiment, the housing body 434 and the handle retainer 436 extend upwardly at an angle of approximately sixty degrees from the channel retainer 438. Alternatively, the housing body 434 and the handle retainer 436 can extend upwardly at an angle of greater than or less than sixty degrees from the channel retainer 438.

Figure 5A:
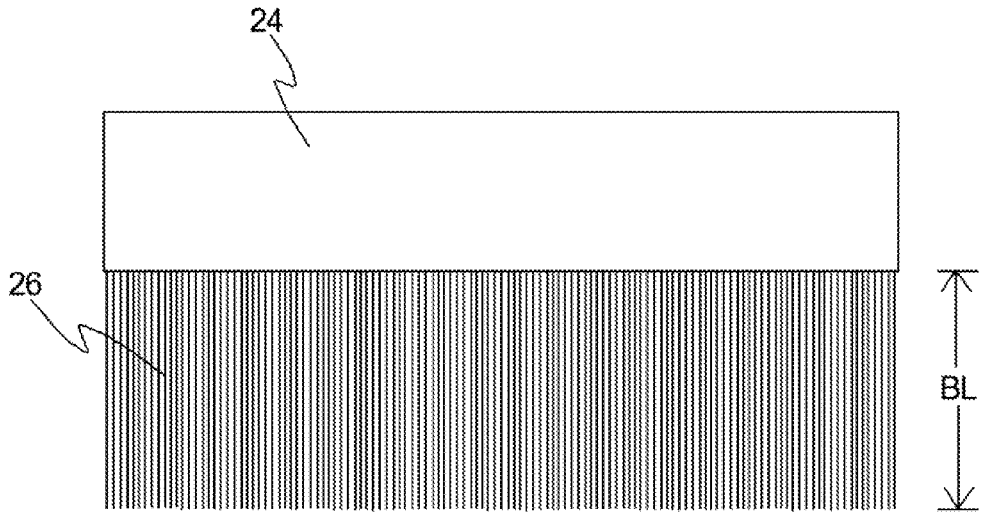
FIG. 5A is a front view of a portion of one embodiment of the turf maintenance device, including a channel and a plurality of bristles.

FIG. 5A is a front view of an embodiment of the channel 24 and the plurality of bristles 26 that form a portion of the turf maintenance device 12 illustrated in FIG. 1A. The design of the channel 24 can be varied to suit the specific requirements of the turf maintenance device 12 (illustrated in FIG. 1A). In this embodiment, the channel 24 is substantially rectangle shaped and the channel 24 is sized and shaped to fit snugly and be retained within the channel retainer aperture 440 (illustrated in FIG. 4B) of the channel retainer 438 (illustrated in FIG. 4A). Moreover, as noted above, the channel 24 can be sized and shaped such that substantially the entire channel 24 is received and retained within the channel retainer aperture 440. Alternatively, the channel 24 can be designed to have a different shape.

The plurality of bristles 26 are retained within and extend substantially perpendicularly away from the channel 24. Moreover, as noted above, the channel 24 maintains the positioning of the bristles 26 relative to one another. In certain embodiments, the bristles 26 extend substantially perpendicularly away from the channel 24 a bristle length BL of from approximately one to three inches. For example, in one embodiment, the bristle length BL is approximately two inches. Alternatively, in different embodiments, the bristles 26 can extend other than substantially perpendicularly away from the channel 24 and/or the bristles 26 can extend away from the channel 24 by greater than three inches or less than one inch.

Further, in one embodiment, the bristles 26 are thin and are formed from a crimped black nylon material. Moreover, the bristles 26 are light and flexible such that the movement of the bristles 26 across the surface of the turf members 16 (illustrated in FIG. 1B) will move any impediments 18 (illustrated in FIG. 1B) from the top of the turf members 16 to between the turf members 16 without otherwise disturbing and/or damaging the turf members 16. Alternatively, the bristles 26 can be formed from another suitable material.

Figure 5B:
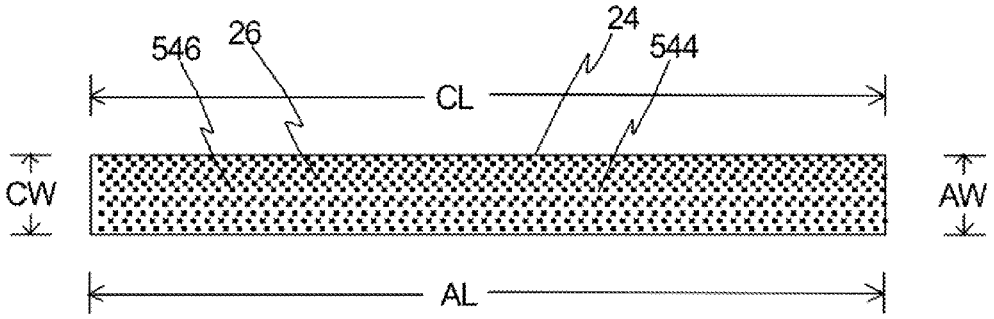
FIG. 5B is a bottom view of the channel and the plurality of bristles illustrated in FIG. 5A.

FIG. 5B is a bottom view of the channel 24 and the plurality of bristles 26 illustrated in FIG. 5A. As illustrated, the channel 24 includes a channel surface 544 on or along which the plurality of bristles 26 are retained. Additionally, as shown, the channel surface 544 has a channel width CW and a channel length CL.

In this embodiment, the bristles 26 are secured to or otherwise retained by the channel 24. As illustrated, the plurality of bristles 26 are positioned about the channel surface 544 of the channel 24 such that the bristles 26 substantially cover the entire channel surface 544 of the channel 24. Stated another way, in this embodiment, other than the limited spacing between the bristles 26 and the limited spacing between the bristles 26 and the outer edge of the surface of the channel 24, the bristles 26 cover all other portions of the channel surface 544. With this design, the plurality of bristles 26 form a bristle array 546 that has the same or slightly greater (due to spreading) approximate length and width as does the channel surface 544. Thus, the bristle array 546 has an array width AW that is approximately equal to the channel width CW, and the bristle array 546 has an array length AL that is approximately equal to the channel length CL. Alternatively, the bristle array 546 can be somewhat smaller than the channel surface 544, i.e. the array width AW is somewhat smaller than the channel width CW and/or the array length AL is somewhat smaller than the channel length CL. Still alternatively, the bristle array 546 can be somewhat greater than the channel surface 544, i.e. the array width AW can be somewhat greater than the channel width CW and/or the array length AL can be somewhat greater than the channel length CL.

In certain embodiments, the array width AW and the channel width CW are each between approximately one-eighth inch and one inch. For example, in one embodiment, the array width AW and the channel width CW are each approximately one-third of an inch. Alternatively, the array width AW and the channel width CW can each be greater than one inch or less than one-eighth inch.

Additionally, in certain embodiments, the array length AL and the channel length CL are each between approximately eight inches and eighteen inches. For example, in one embodiment, the array length AL and the channel length CL are each approximately twelve inches. Alternatively, the array length AL and the channel length CL can each be greater than eighteen inches or less than eight inches.

Further, in certain non-exclusive alternative embodiments, the ratio of array length AL to array width AW can be at least approximately 8:1, 10:1, 12:1, 15:1, 20:1, 25:1, 30:1, 40:1, 50:1, 75:1, 100:1 or 144:1.

Still further, in certain non-exclusive alternative embodiments, the ratio of bristle length BL to array width AW can be at least approximately 1:1, 1.5:1, 2:1, 3:1, 4:1, 5:1, 6:1, 8:1, 10:1, 12:1 or 16:1.

Figure 6A:
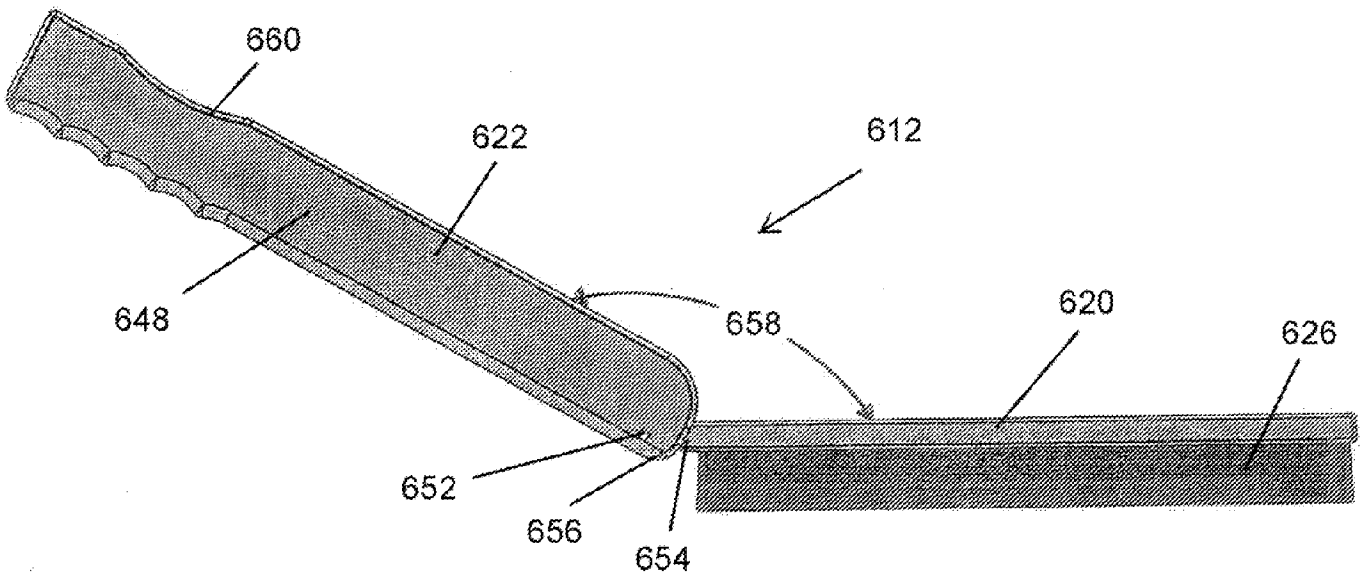
FIG. 6A is a side view of yet another embodiment of the turf maintenance device, shown in an operative configuration.
Figure 6C:
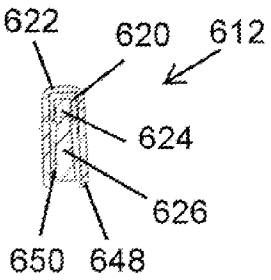
FIG. 6C is a cross-sectional end view of the turf maintenance device taken on line C-C in FIG. 6B.
Figure 6B:
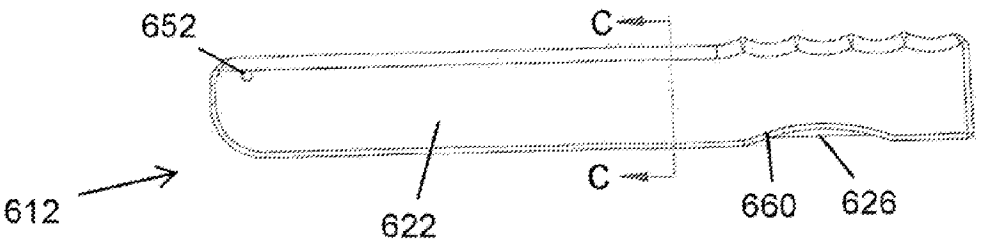
FIG. 6B is a side view of the turf maintenance device illustrated in FIG. 6A, shown in a stored configuration.

FIG. 6A and FIG. 6B are side views of yet another embodiment of the turf maintenance device 612. Additionally, FIG. 6C is a cross-sectional end view of the turf maintenance device 612 taken on line C-C in FIG. 6B.

In particular, in this embodiment, the turf maintenance device 612 is selectively movable between an operative configuration, as illustrated in FIG. 6A, and a stored configuration, as illustrated in FIG. 6B. In the operative configuration, the turf maintenance device 612 can be quickly and easily moved across the surface of the turf members 16 (illustrated in FIG. 1B) to move the plurality of impediments 18 (illustrated in FIG. 1B) from the top of the turf members 16 to between the turf members 16 and substantially adjacent to the turf base 14 (illustrated in FIG. 1B), while inhibiting any potential damage to the individual turf members 16. Additionally, in the stored configuration, the turf maintenance device 612 has a more compact overall form which enhances the convenience of storage and/or transport of the turf maintenance device 612. For example, when in the stored configuration, the turf maintenance device 612 can be more easily stored and transported within a golf bag for use by a player or caddie while golfing.

As illustrated in this embodiment, the turf maintenance device 612 is somewhat similar to one or more of the turf maintenance previously illustrated and described herein. For example, as illustrated in this embodiment, the turf maintenance device 612 includes a housing 620, a handle 622, a channel 624 (illustrated in FIG. 6C) and a plurality of bristles 626. However, in this embodiment, the handle 622 has a somewhat different design than the previous embodiments, and the housing 620 is coupled to the handle 622 in a somewhat different manner.

As illustrated, the handle 622 includes a handle body 648 that defines a handle cavity 650 (illustrated in FIG. 6C). The handle cavity 650 is sized and shaped to receive the housing 620, the channel 624 and the plurality of bristles 626, such that the housing 620, the channel 624 and the bristles 626 are positioned substantially within the handle cavity 650 when the turf maintenance device 612 is in the stored configuration.

Additionally, the turf maintenance device 612 further includes a housing pivot 652 to pivotably couple the housing 620 to the handle 622. In one embodiment, the housing pivot 652 is positioned such that a housing end 654 is pivotably coupled to the handle 622 near a handle end 656. With this design, the housing 620 can extend in a generally outward direction further away from the handle 622, and the turf maintenance device 612 can have an overall longer profile when the turf maintenance device 612 is in the operative configuration. Moreover, the housing 620 extends away from the handle 622 such that the housing 620 and the handle 622 are positioned essentially in a single plane. Alternatively, the housing 620 can be coupled to the handle 622 in a different manner and/or the housing pivot 652 can be located in a different position.

Further, as illustrated in FIG. 6A, the turf maintenance device 612 has a working angle 658, which is the angle between the housing 620 and the handle 622 when the turf maintenance device 612 is in the operative configuration. In one embodiment, the working angle 658 can be approximately 150 degrees and the working angle 658 can be fixed and/or locked when the turf maintenance device 612 is in the operative configuration. Alternatively, the working angle 658 can be greater than or less than 150 degrees. Still alternatively, the working angle 658 can be adjustable such that the housing 620 and the handle 622 can be positioned in a fixed manner relative to one another in the operative configuration to suit the comfort of the user.

Still further, as illustrated, the handle 622 can include a handle cutout 660 to enable easy access to one or more of the housing 620, the channel 624 and the bristles 626 when the turf maintenance device 612 is in the stored configuration. With this design, the turf maintenance device 612 can be easily moved from the stored configuration to the operative configuration.

It should be noted that one or more of the features of any one embodiment of the turf maintenance device can be combined with one or more of the features of any one or more of the other embodiments without altering the intended purpose of the turf maintenance device.

With the design and dimensions as described in detail herein, the turf maintenance device 12 (illustrated in FIG. 1A) can be effectively useful for moving the plurality of impediments 18 (illustrated in FIG. 1B) from the top of the turf members 16 (illustrated in FIG. 1B) to between the turf members 16 and substantially adjacent to the turf base 14 (illustrated in FIG. 1B), without otherwise damaging the individual turf members 16.

While a number of exemplary aspects and embodiments of a turf maintenance device 12 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A device comprising:

a housing including a handle retainer, a channel retainer, and a housing body that is connected to the handle retainer and the channel retainer, wherein the channel retainer is rectangular in shape, wherein the housing body comprises a pair of substantially triangular portions that extend from the handle retainer to an end of the channel retainer, a length of the channel retainer is equal to a length from an outer end of one of the pair of substantially triangular portions to an outer end of the other one of the pair of substantially triangular portions, the channel retainer forming a single channel retainer aperture that is coextensive in length with the channel retainer;

a telescoping handle that is coupled to the housing, the telescoping handle being retained by the handle retainer and comprising a plurality of handle members that move relative to one another between an extended configuration and a contracted configuration;

a channel that is received by the channel retainer aperture and retained by the channel retainer, wherein the channel is sized and shaped to fit snugly within the channel retainer aperture, the channel is coextensive in length with the channel retainer; and a plurality of bristles that are retained by the channel and continuously disposed along an entire length of the channel and the channel retainer, the plurality of bristles having an array length, an array width and a bristle length, the ratio of the array length to the array width being at least approximately ten to one, and the ratio of the bristle length to the array width being at least approximately three to one.

2. The device of claim 1 wherein the housing body is integrally formed with the handle retainer and the channel retainer.

3. The device of claim 1 wherein the handle retainer extends away from the channel retainer at an angle of approximately sixty degrees.

4. A device comprising:

a plurality of bristles, the plurality of bristles having an array length, an array width and a bristle length, the ratio of the array length to the array width being at least approximately eight to one, and the ratio of the bristle length to the array width being at least approximately three to one;

a telescoping handle comprising a plurality of handle members that move relative to one another between an extended configuration and a contracted configuration;

a channel that retains the plurality of bristles, the plurality of bristles continuously disposed along an entire length of the channel; and a housing including (i) a handle retainer that retains the telescoping handle, (ii) a channel retainer comprising a single channel retainer aperture that receives the channel, the channel retainer aperture is coextensive in length with the channel retainer and channel, wherein the channel is sized and shaped to fit snugly and be retained within the channel retainer at the channel retainer aperture, the channel retainer is rectangular in shape, and (iii) a housing body that is connected to the handle retainer and the channel retainer, the housing body being integrally formed with the handle retainer and the channel retainer, wherein the housing body comprises a pair of substantially triangular portions that extend from the handle retainer to an end of the channel retainer, and a length of the channel retainer is equal to a length from an outer end of one of the pair of substantially triangular portions to an outer end of the other one of the pair of substantially triangular portions.

5. The device of claim 4 wherein the handle retainer extends away from the channel retainer at an angle of approximately sixty degrees.

6. A device comprising:

a housing including a channel retainer and a housing body that is connected to the channel retainer, wherein the channel retainer is rectangular in shape, wherein the housing body comprises a pair of substantially triangular portions that extend from a handle retainer to an end of the channel retainer, a length of the channel retainer is equal to a length from an outer end of one of the pair of substantially triangular portions to an outer end of the other one of the pair of substantially triangular portions, the channel retainer forming a single channel retainer aperture that is coextensive in length with the channel retainer;

a channel that is received by the channel retainer aperture and retained by the channel retainer, wherein the channel is sized and shaped to fit snugly within the channel retainer the channel is coextensive in length with the channel retainer; and a plurality of bristles that are retained by the channel and continuously disposed along an entire length of the channel and the channel retainer.

7. The device of claim 6 wherein the housing body is integrally formed with the channel retainer.

8. The device of claim 6 wherein the plurality of bristles form a bristle array having an array length and an array width, the ratio of the array length to the array width being at least approximately ten to one.

9. The device of claim 8 wherein the ratio of array length to array width is at least approximately thirty to one.

10. The device of claim 8 wherein the plurality of bristles have a bristle length, the ratio of the bristle length to the array width being at least approximately three to one.

11. The device of claim 10 wherein the ratio of the bristle length to the array width is at least approximately five to one.

12. The device of claim 6 further comprising a telescoping handle, the housing including the handle retainer that is connected to the housing body, the telescoping handle being retained by the handle retainer and comprising a plurality of handle members that move relative to one another between an extended configuration and a contracted configuration.

13. The device of claim 12 wherein the housing body is integrally formed with the handle retainer and the channel retainer.

14. The device of claim 6 further comprising a foldable handle that is coupled to the housing.

* * * * *